US007216498B2

(12) United States Patent
Manole et al.

(10) Patent No.: US 7,216,498 B2
(45) Date of Patent: May 15, 2007

(54) METHOD AND APPARATUS FOR DETERMINING SUPERCRITICAL PRESSURE IN A HEAT EXCHANGER

(75) Inventors: Dan M Manole, Tecumseh, MI (US); Alicia Frostick, Ann Arbor, MI (US)

(73) Assignee: Tecumseh Products Company, Tecumseh, MI (US)

( * ) Notice: Subject to any disclaimer, the term of this patent is extended or adjusted under 35 U.S.C. 154(b) by 470 days.

(21) Appl. No.: 10/902,635

(22) Filed: Jul. 29, 2004

(65) Prior Publication Data

US 2005/0066675 A1 Mar. 31, 2005

Related U.S. Application Data

(60) Provisional application No. 60/505,817, filed on Sep. 25, 2003.

(51) Int. Cl.
*F25D 25/00* (2006.01)

(52) U.S. Cl. ..... 62/208; 62/126; 62/129; 62/209

(58) Field of Classification Search ..... 62/208, 62/126, 129, 209; 165/279, 11.1
See application file for complete search history.

(56) References Cited

U.S. PATENT DOCUMENTS

| | | | | |
|---|---|---|---|---|
| 4,545,254 | A | 10/1985 | Lawless et al. | 73/714 |
| 5,245,836 | A * | 9/1993 | Lorentzen et al. | 62/174 |
| 5,481,920 | A | 1/1996 | Nara | 73/726 |
| 5,655,378 | A * | 8/1997 | Pettersen | 62/174 |
| 5,685,160 | A * | 11/1997 | Abersfelder et al. | 62/114 |
| 6,267,010 | B1 | 7/2001 | Hatanaka et al. | 73/756 |
| 6,343,486 | B1 * | 2/2002 | Mizukami | 62/509 |
| 6,393,919 | B1 | 5/2002 | Ohji et al. | 73/708 |
| 6,568,199 | B1 | 5/2003 | Manohar et al. | 62/223 |
| 6,591,683 | B1 | 7/2003 | Yutani et al. | 73/708 |
| 6,619,130 | B1 | 9/2003 | Yutani et al. | 73/716 |
| 6,698,214 | B2 * | 3/2004 | Chordia | 62/114 |
| 2002/0083723 | A1 | 7/2002 | Demuth et al. | 62/129 |
| 2003/0177782 | A1 | 9/2003 | Gopalnarayanan et al. | 62/505 |
| 2003/0221435 | A1 * | 12/2003 | Howard | 62/228.3 |

FOREIGN PATENT DOCUMENTS

JP 2003004316 A 1/2003

* cited by examiner

*Primary Examiner*—Cheryl Tyler
*Assistant Examiner*—Gene Bankhead
(74) *Attorney, Agent, or Firm*—Baker & Daniels LLP

(57) ABSTRACT

A method and apparatus to determine the pressure of a supercritical refrigerant within a heat exchanger of a transcritical vapor compression system. A plurality of measurements, e.g., temperature, are obtained at spaced locations on the heat exchanger and the location of the minimum temperature gradient, i.e., maximum specific heat value of the refrigerant, is determined ("the inflection point"). Obtaining the refrigerant temperature at the inflection point allows the refrigerant pressure to be determined. Alternatively, the temperature of the refrigerant at a second point can be determined together with the change in specific enthalpy between the inflection point and the second point to thereby determine the pressure of the refrigerant. The system can be regulated by controlling the location of the inflection point or by controlling the temperature difference of the refrigerant at the inflection point and a second point, e.g., the outlet of the heat exchanger.

26 Claims, 6 Drawing Sheets

METHOD AND APPARATUS FOR DETERMINING SUPERCRITICAL PRESSURE IN A HEAT EXCHANGER

CROSS REFERENCE TO RELATED APPLICATIONS

This application claims the benefit under Title 35, U.S.C. § 119(e) of U.S. Provisional Patent Application Ser. No. 60/505,817, entitled METHOD AND APPARATUS FOR DETERMINING SUPERCRITICAL PRESSURE IN A HEAT EXCHANGER, filed on Sep. 25, 2003.

BACKGROUND OF THE INVENTION

The present invention relates to vapor compression systems and, more specifically, to determining the supercritical pressure within a heat exchanger in a transcritical vapor compression system.

In a typical vapor compression system, the refrigerant remains at subcritical pressures throughout the system. However, for some refrigerants, such as carbon dioxide, it is typical to operate the system as a transcritical vapor compression system wherein the refrigerant is at a supercritical pressure on the high pressure side of the system and at a subcritical pressure on the low pressure side of the system.

In such a transcritical system the refrigerant is compressed to a supercritical pressure in the compressor and then cooled in a heat exchanger, commonly called a gas cooler. After the refrigerant is cooled in the gas cooler, it is passed through an expansion device to lower its pressure from a supercritical pressure to a subcritical pressure. The low pressure refrigerant then enters an evaporator wherein the refrigerant absorbs thermal energy as it changes phase from a liquid to a vapor.

When a refrigerant is compressed to a supercritical pressure, i.e., a pressure above its critical pressure, the liquid and vapor phases of the refrigerant are indistinguishable and the refrigerant is commonly referred to as a gas. When the refrigerant is at a supercritical pressure, the phase of the refrigerant does not change by heating or cooling the refrigerant.

In a conventional vapor compression system wherein the refrigerant is not compressed to a supercritical pressure, when the pressure of the refrigerant in the condenser is monitored, i.e., the high pressure heat exchanger, it is typically directly measured by a pressure sensor that penetrates the structure forming the condenser. In a transcritical system, the pressure in the gas cooler will generally be substantially higher than that found in a conventional condenser and it is undesirable to penetrate the structure forming the gas cooler because such a penetration increases the possibility of a subsequent leak. Other methods of determining the pressure of a refrigerant which is at a subcritical pressure using the temperature or other physical parameter of the refrigerant are also known, however, such methods will generally not be applicable to a refrigerant at a supercritical pressure.

The Gibbs Phase Rule can be used to determine the degrees of freedom in a system and thereby indicate the number of parameters required to determine the thermodynamic state of the fluid system and states:

$$p+f=c+2$$

wherein, p=the number of phases; f=number of degrees of freedom in the system, i.e., the number of required parameters; and c=number of components in the thermodynamic system. Thus, a single phase system will have one more degree of freedom than a similar two phase system. For example, the temperature of a refrigerant can be used to determine the pressure of the refrigerant when the refrigerant is at a subcritical pressure and in a two phase state. For a refrigerant at a supercritical pressure and limited to a single phase, however, two physical parameters, such as temperature, pressure, specific volume or density, are required to determine any other thermodynamic property of the refrigerant.

SUMMARY OF THE INVENTION

The present invention provides a method and apparatus for determining the pressure of a supercritical fluid within a heat exchanger without directly measuring the pressure of the fluid.

The present invention comprises, in one form thereof, a method of determining the supercritical pressure of a refrigerant in a heat exchanger in a transcritical vapor compression system wherein the method includes obtaining a plurality of measurements representative of the temperature of the refrigerant at spaced locations on the heat exchanger, identifying a first location based upon the plurality of measurements wherein the first location is the approximate location of the minimum temperature gradient of the refrigerant within the heat exchanger, and determining the pressure of the refrigerant within the heat exchanger based upon the identification of the first location.

The pressure of the refrigerant may be obtained by determining the approximate temperature of the refrigerant at the first location and determining the pressure at which the refrigerant has a maximum specific heat at a temperature equivalent to the temperature of the refrigerant at the first location. This may be done in various manners including the use of a look-up table.

The pressure of the refrigerant may also be obtained by determining the approximate temperature of the refrigerant at a second location spaced from the first location, determining the approximate change in specific enthalpy of the refrigerant between the first location and the second location (or other value that is a function of the change in specific enthalpy between the first and second locations), and determining the pressure of the refrigerant at the first location based upon the approximate temperature of the refrigerant at the second location and the approximate change in specific enthalpy between the first and second locations. In such a method, the heat exchanger may be cooled using ambient air and, when the second location is the heat exchanger outlet, the temperature of the refrigerant at the second location may be estimated to be equivalent to the temperature of the ambient air.

The approximate change in specific enthalpy between the first and second locations can be calculated using the following equation:

$$\Delta h_{INF} = \frac{1}{\dot{m}} \frac{\partial Q}{\partial L} (\Delta L_{INF})$$

wherein:

$\Delta h_{INF}$ is the change in specific enthalpy;

$\dot{m}$ is the mass flow rate of refrigerant through the heat exchanger;

$$\frac{\partial Q}{\partial L}$$

is the heat transfer rate of the heat exchanger; and $\Delta L_{INF}$ is the length between the first and second locations.

The plurality of measurements representative of the temperature of the refrigerant at spaced locations on the heat exchanger can be obtained by various means including taking temperature measurements on the exterior surface of the heat exchanger or by obtaining strain measurements of the heat exchanger structure at the spaced locations.

The first location, corresponding to the point at which the refrigerant has a maximum specific heat and, thus, also has a minimal temperature gradient, may be identified by comparing the plurality of measurements and selecting a pair of adjacent measurements that define the minimal difference between adjacent measurements. Alternatively, the first location may be identified by the use of a curve based upon the plurality of measurements and the position of the measurements on the heat exchanger.

The current invention comprises, in another form thereof, a method of controlling the operation of a transcritical vapor compression system wherein the vapor compression system defines a closed loop circuit through which a refrigerant is circulated and includes therein, in serial order, a compressor, a first heat exchanger, an expansion device and a second heat exchanger wherein the refrigerant is at a supercritical pressure within the first heat exchanger. The method includes identifying a first location on the first heat exchanger wherein the first location is the approximate location of the minimum temperature gradient of the refrigerant within the heat exchanger and regulating the operation of the transcritical vapor compression system by controlling at least one characteristic of the first location.

The characteristic of the first location that is controlled may be the distance that separates the first location from the outlet of the first heat exchanger and/or the temperature of the refrigerant at the first location. Regulating the operation of the transcritical vapor compression system may include maintaining the distance between the first location and the outlet of the first heat exchanger at a relatively constant value. Regulating the operation of the system may alternatively include maintaining a desired temperature difference between refrigerant at the first location and refrigerant at the outlet of the first heat exchanger. In some embodiments, the temperature difference that is maintained in the regulation of the system may be a non-variable temperature difference, i.e., a constant value. When the first heat exchanger utilizes ambient air as a cooling medium, it may be advantageous to assume that the temperature of refrigerant at the outlet of the first heat exchanger is equivalent to the temperature of the ambient air.

The present invention comprises, in yet another form thereof, a transcritical vapor compression system that includes a closed loop circuit through which a refrigerant is circulated. The circuit includes, in serial order, a compressor, a first heat exchanger, an expansion device and a second heat exchanger and wherein the refrigerant is at a supercritical pressure within the first heat exchanger. A plurality of sensing devices are mounted on the first heat exchanger at spaced locations and each of the devices generate a signal representative of the temperature of the refrigerant within the first heat exchanger at a respective one of the spaced locations. The system also includes means for identifying a first location based upon the signals wherein the first location is the approximate location of the minimum temperature gradient of the refrigerant within the first heat exchanger and means for determining the pressure of the refrigerant within the first heat exchanger based upon the identification of the first location.

One advantage of the present invention is that some embodiments provide for the determination of the pressure of a supercritical refrigerant in a heat exchanger using measurements that can be taken on the exterior surface of the heat exchanger without requiring the penetration of the heat exchanger structure.

Another advantage of the present invention is that it can be used to monitor and regulate the supercritical pressure within a heat exchanger without directly measuring the refrigerant pressure within the heat exchanger.

BRIEF DESCRIPTION OF THE DRAWINGS

The above-mentioned and other features and objects of this invention will become more apparent and the invention itself will be better understood by reference to the following description of embodiments of the invention taken in conjunction with the accompanying drawings, wherein.

Figure 1:
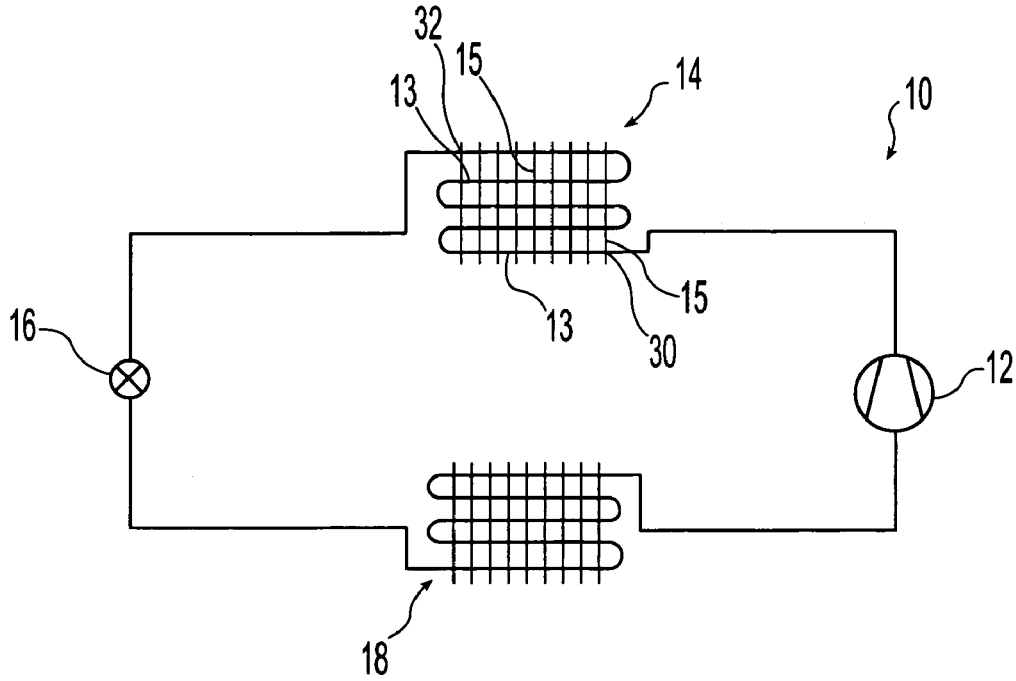
FIG. 1 is a schematic view of a transcritical vapor compression system.

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise form disclosed.

DETAILED DESCRIPTION

Referring to FIG. 1, transcritical vapor compression system 10 includes compressor 12, a first heat exchanger, e.g., a gas cooler, 14, expansion device 16, and a second heat exchanger, e.g., an evaporator 18, connected in series by fluid conduits. In alternative embodiments, transcritical system 10 may include additional features or components such as a two stage compressor mechanism that employs an intercooler to cool the intermediate pressure refrigerant between the first and second compressor stages or a suction line heat exchanger that exchanges thermal energy between the refrigerant at a first location between gas cooler 14 and expansion device 16 and the refrigerant at a second location between evaporator 18 and compressor 12 to thereby further cool the refrigerant before passing it through expansion device 16.

In operation, refrigerant is compressed in compressor 12 to a supercritical pressure. The relatively warm, supercritical refrigerant is then cooled in gas cooler 14. The pressure of the refrigerant is then reduced to a subcritical pressure by expansion device 16. After passing through expansion device 16 the relatively low pressure refrigerant is in a liquid phase, or primarily in a liquid phase, when it enters evaporator 18. The liquid phase refrigerant is then converted to a gas phase in evaporator 18 thereby cooling the air passing over evaporator 18. The refrigerant vapor exiting evaporator 18 is then returned to compressor 12 and the cycle is repeated.

System 10 has numerous applications. For example, system 10 could be employed in a water heater with the first heat exchanger 14 being used to heat the water. Alternatively, system 10 could be employed as a refrigeration or air conditioning system wherein evaporator 18 is used to cool air that is then used to cool a refrigerated cabinet or interior building space.

In exemplary system 10 discussed herein, the refrigerant employed is carbon dioxide. The present invention, however, may alternatively employ other refrigerants suitable for use in a transcritical vapor compression system.

Figure 2:
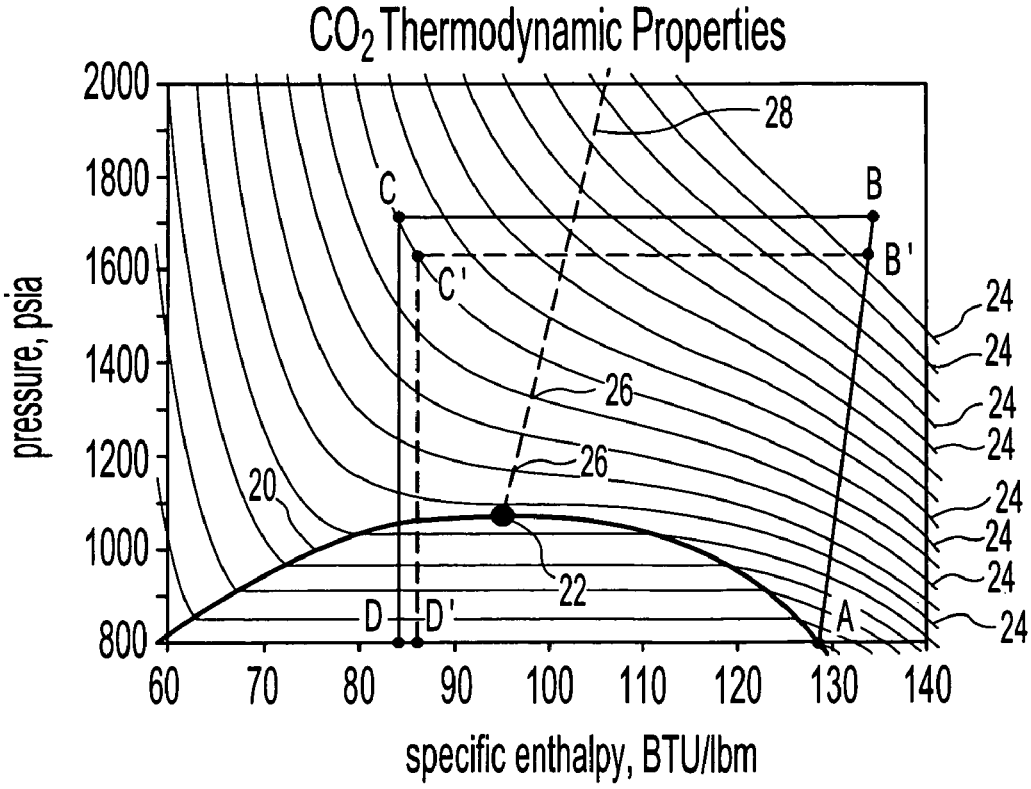
FIG. 2 is a pressure-enthalpy diagram for carbon dioxide that also illustrates the operation of the transcritical vapor compression system of FIG. 1.

FIG. 2 provides a chart illustrating the thermodynamic properties of carbon dioxide and the operation of system 10. In FIG. 2, the pressure and specific enthalpy values are plotted wherein specific enthalpy is enthalpy per unit mass. In FIG. 2, line 20 represents the liquid/vapor saturation curve. That portion of line 20 to the left of point 22 defines the liquid saturation curve while that portion of line 20 to the right of point 22 defines the vapor saturation curve. The point 22 defines the boundary between supercritical and subcritical conditions for the refrigerant, i.e., carbon dioxide in the exemplary embodiment. Above point 22, carbon dioxide is at supercritical conditions and the carbon dioxide does not have distinguishable liquid and vapor phases and is typically referred to as a gas. Below liquid/vapor saturation curve 20 is a two phase region where the liquid and vapor phases of carbon dioxide coexist. At pressures above the critical pressure identified at location 22, carbon dioxide will remain in a supercritical state regardless of the temperature of the carbon dioxide. In other words, at such supercritical pressures, as can be found in gas cooler 14, it is not possible to condense the carbon dioxide into a liquid phase by cooling and the cooled carbon dioxide will remain a supercritical gas.

Also shown on FIG. 2 are isotherm lines 24 each of which represent the locus of pressure and specific enthalpy conditions of carbon dioxide at a specific temperature. The slope of isotherms 24 is related to the specific heat ($c_p$) of the carbon dioxide with a minimum absolute value of the slope of the isotherm line indicating a maximum specific heat. The specific heat of a substance refers to the quantity of energy required to raise the temperature of a unit mass of the substance by an incremental unit measurement of temperature. The horizontal length of isotherms 24 at subcritical conditions below liquid/vapor saturation curve 20 reflects the energy required to convert carbon dioxide between its liquid and vapor phases. In other words, carbon dioxide boils at a constant temperature and pressure. Above the liquid/vapor saturation curve 20, carbon dioxide does not change phases and isotherms 24 do not include any horizontal lengths. Local maximum values of the specific heat of carbon dioxide at supercritical conditions are found at inflection points 26 in isotherms 24 above the liquid/vapor saturation curve 20 and dashed line 28 connects such inflection points 26.

The operation of system 10 is also represented in FIG. 2. More specifically, the geometric figures ABCD and AB'C'D' represent the thermodynamic cycle of system 10 in two separate operating modes. Turning first to cycle ABCD which represents the normal operational mode of system 10, point A represents the condition of the carbon dioxide at the inlet of compressor 12. Movement from point A to point B represents the increase in pressure and temperature caused by the compression of the carbon dioxide in compressor 12. Movement from point B to point C represents the cooling of the supercritical carbond dioxide in gas cooler 14 at an essentially constant pressure. Movement from point C to point D represents the reduction in pressure resulting from the passage of the carbon dioxide through expansion device 16. Movement from point D to point A represents the energy input required to convert the carbon dioxide from the liquid phase to the vapor phase in evaporator 18. In a system used for cooling purposes, e.g., a refrigerated cabinet or air conditioning application, the length of the line DA represents the cooling capacity of the system. Similarly, in a heating application, e.g., a water heating system, the length of line BC represents the heating capacity of the system.

The thermodynamic cycle represented by AB'C'D' reflects the operation of system 10 at a reduced capacity. In this second mode of operation, the conditions of the carbon dioxide at the inlet to compressor 12, represented by point A, are the same as in the first, normal, operating mode. In this second mode of operation, the carbon dioxide is compressed to a lesser pressure as shown by point B' which represents the conditions of the carbon dioxide discharged from compressor 12. The carbon dioxide is then cooled in gas cooler 14 to the same outlet temperature as in the first mode of operation as represented by point C' which lies on the same isotherm as point C. For example, if the carbon dioxide in gas cooler 14 were cooled to a common ambient air temperature in both modes of operation, points C and C' would lie on the same isotherm as shown. As a result of the lower gas cooler pressure and common outlet temperature, point C' is positioned to the right of point C on the chart of FIG. 2. The reduction of pressure resulting from the passage of the carbon dioxide through expansion device 16 is represented by movement from point C' to point D' and, as can be seen in FIG. 2, as a result of point C' being positioned to the right of point C, i.e., having a higher specific enthalpy than that of point C, point D' is also positioned to the right of point D. The shorter length of line D'A relative to line DA represents the reduced cooling capacity of system 10 in the second operating mode. Similarly, the reduced length of line B'C' compared to line BC represents a reduction in the heating capacity of system 10.

FIG. 2 represents a system wherein the expansion of the refrigerant is isenthalpic and occurs at a constant specific enthalpy as depicted by the vertical orientation of lines CD and C'D'. The expansion of the refrigerant may alternatively occur under isentropic conditions at a constant entropy wherein lines CD and C'D' would remain substantially parallel and each have a slight slope, i.e., points D and D' would be at a higher specific enthalpy than points C and C' respectively. For example isentropic expansion may occur when there is internal heat transfer due to friction during the expansion process. The net result for both isenthalpic and isentropic expansion, however, is similar with a reduction in the pressure in the gas cooler resulting in reduced capacity when the temperature of the refrigerant at the outlet of the gas cooler remains constant. Consequently, while FIG. 2 depicts an isenthalpic expansion, the discussion presented herein is also applicable to a system wherein the expansion of the refrigerant occurs under isentropic conditions.

In addition to the capacity of system 10, the coefficient of performance (COP) is also a function of the pressure of the supercritical carbon dioxide in gas cooler 14. Consequently, it is desirable to measure the pressure in gas cooler 14 to facilitate the monitoring and regulation of transcritical system 10.

As can be seen in FIG. 2, lines BC and B'C' intersect a plurality of isotherm lines 24 and taking a single temperature measurement, or a single measurement of another thermophysical parameter such as density or viscosity, of the carbon dioxide within gas cooler 14 will not, without additional information, be sufficient to determine the pressure of the carbon dioxide within gas cooler 14. The present invention, in one embodiment thereof, however, determines the temperature of the carbon dioxide at several points along the length of gas cooler 14 and thereby also determines the pressure of the carbon dioxide within gas cooler 14 as explained below. In alternative embodiments, an appropriate thermophysical parameter of the refrigerant other than temperature could be determined at several locations on gas cooler 14 to determine the pressure within gas cooler 14.

Figure 3:
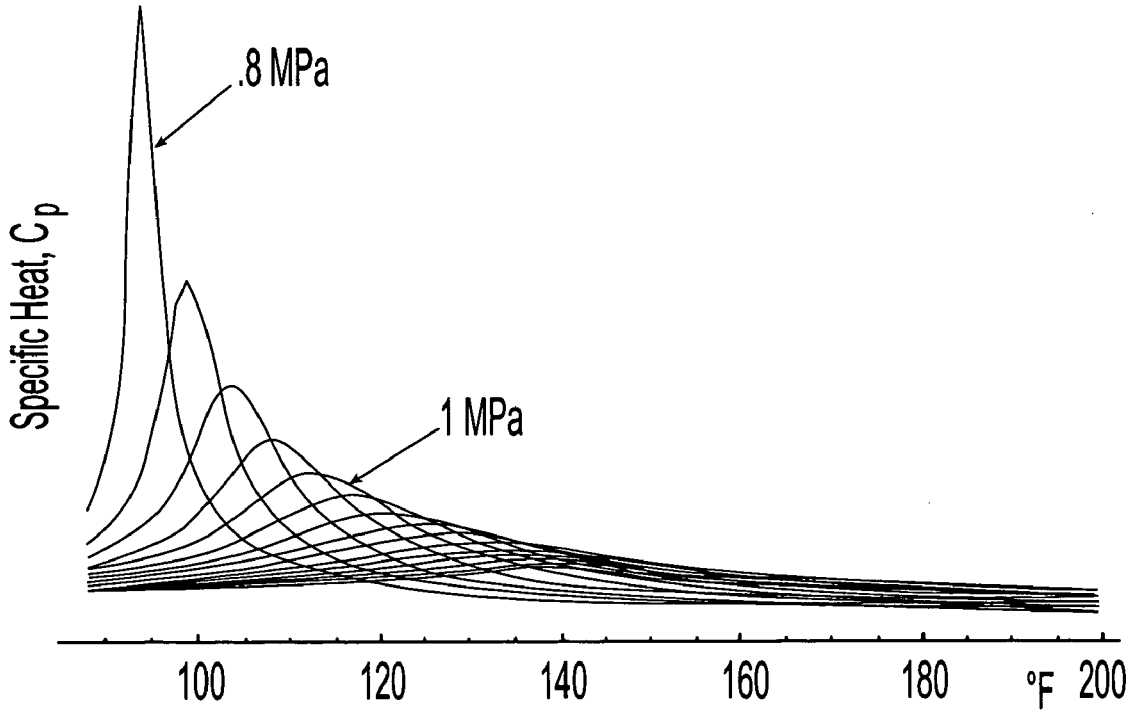
FIG. 3 is a specific heat-temperature diagram of carbon dioxide at various pressures.

FIG. 3 illustrates how the specific heat of carbon dioxide varies with a variation in temperature. As also shown in FIG. 3, the pressure of the carbon dioxide determines both the maximum value of the specific heat and the temperature at which the maximum specific heat value occurs. Employing this relationship between specific heat, temperature and pressure, the temperature gradient of the heat exchanger can be used to determine both the temperature and physical location of the carbon dioxide within the heat exchanger having a maximum specific heat value.

Figure 4:
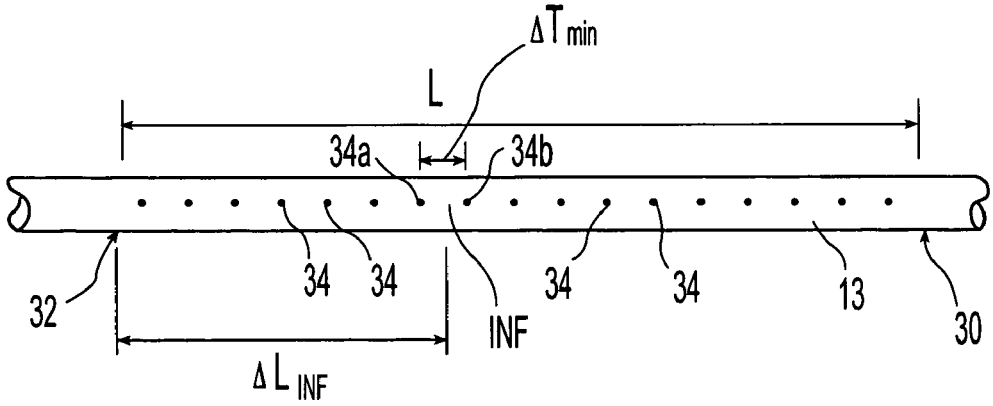
FIG. 4 is a schematic representation of the gas cooler of FIG. 1.

As depicted in FIG. 1, gas cooler or heat exchanger 14 may be formed by a serpentine tube 13 having heat radiating fins 15 mounted thereon as is well known in the art. The refrigerant, e.g., carbon dioxide, within tube 13 exchanges thermal energy with tube 13 which, in turn, exchanges thermal energy with fins 15. A second heat exchange medium, e.g., ambient air blown over fins 15 with an air blower, exchanges thermal energy with fins 15 to thereby cool the refrigerant within tube 13. FIG. 4 schematically represents heat exchanger 14 depicting only the effective length of tube 13 and representing it as a straight tube to facilitate the clarification of the principles underlying the present invention. That length of tube 13 which functions as a heat exchanger is depicted as length L in FIG. 4 and extends from proximate the inlet 30 to proximate the outlet 32 of heat exchanger 14.

By taking a plurality of temperature measurements along the length of tube 13, e.g., at equally spaced sensing locations 34, the temperature variations between each adjacent pair of locations 34 can be determined. For example, as depicted in FIG. 4, the adjacent pair of sensing locations 34*a* and 34*b* define the minimal temperature variation ($\Delta T_{min}$) and the inflection point INF (corresponding to the maximum specific heat value of the refrigerant) is assumed to be at the midpoint between sensing locations 34*a* and 34*b*. The distance $L_{INF}$ is the distance between the inflection point INF and outlet 32. As described in greater detail below, the present invention may be implemented by directly sensing the temperature of tube 13 or by sensing another physical parameter that varies with variations in temperature, e.g., the use of strain gages to measure the strain of tube 13. Such measurements would be acquired by appropriate sensing devices, such as temperatures sensors, thermistors, strain gages, or other commonly available sensing device, and would be mounted on heat exchanger 14 at spaced intervals as symbolically represented by sensing locations 34 in FIG. 4. The illustrated sensing locations 34 are equally spaced, however, the sensing locations used with the present invention are not required to have equal spacing provided that the relative positions of the sensing locations are known.

Figure 5:
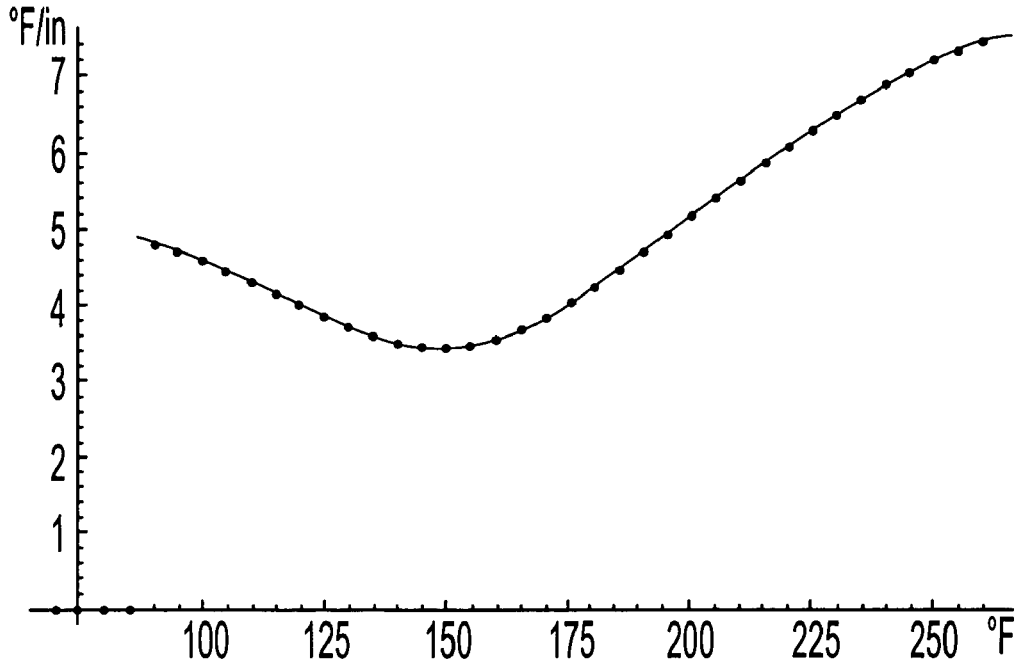
FIG. 5 is an example of a temperature gradient-temperature diagram.

FIG. 5 is a chart illustrating an example of temperature variations along the length of tube 13 by plotting the change in temperature per unit length of heat exchanger tube along the vertical axis and the measured temperature of the heat exchanger tube, which is assumed to be the same as the refrigerant within the tube, along the horizontal axis. In the example illustrated in FIG. 5, the minimal temperature variation, or gradient, occurs at approximately 152° F. Thus, the supercritical carbon dioxide within tube 13 has a maximum specific heat value at this same temperature. The specific enthalpy, specific heat and temperature of supercritical carbon dioxide are related as follows:

$$h=c_p*T_{absolute}$$

wherein h is specific enthalpy, $c_p$ is specific heat, and $T_{absolute}$ is the absolute temperature in Rankine ($t_{Rankine}=t_{Fahrenheit}+459.69$).

The temperature at which the maximum specific heat value occurs can then be used to determine the pressure of the carbon dioxide within gas cooler 14 by using a look up table, a chart, or by solving the appropriate mathematical equations. For example, after plotting the data points represented in FIG. 5, the temperature of the minimal temperature variation could be determined by visual inspection. A curve, fitted to the data points, is also shown in FIG. 5. The minimal temperature variation is advantageously identified after fitting such a curve to the data points. The use of such a curve facilitates the use of a microprocessor. The microprocessor may be employed to define the second order polynomial curve that best fits the data points using conventional software applications.

Presented below is a lookup table that presents the temperature (° F.) of carbon dioxide at its inflection point (i.e., its maximum specific heat) and the corresponding pressure. Thus, for the example of FIG. 5 wherein the inflection point INF has a temperature of approximately 152° F., the chart below could be used to determine that the pressure within the gas cooler would be approximately 2170 psia (using linear interpolation between listed values). Similarly, if the temperature of at the inflection point INF was determined to be 126.5° F., the corresponding pressure would be 1700 psia.

Inflection point (maximum specific heat) temperatures and corresponding pressures for carbon dioxide

| t, ° F. | p, psia |
|---|---|
| 88.6 | 1080 |
| 90.0 | 1100 |
| 96.8 | 1200 |
| 103.3 | 1300 |
| 109.5 | 1400 |
| 115.5 | 1500 |
| 121.1 | 1600 |

-continued

| Inflection point (maximum specific heat) temperatures and corresponding pressures for carbon dioxide | |
|---|---|
| t, ° F. | p, psia |
| 126.5 | 1700 |
| 131.6 | 1800 |
| 136.4 | 1900 |
| 141.0 | 2000 |
| 145.3 | 2100 |
| 149.4 | 2200 |
| 153.2 | 2300 |
| 156.8 | 2400 |
| 160.2 | 2500 |

With reference to FIG. 2, the point at which lines BC and B'C' intersect dashed line 28 corresponds to the point in gas cooler 14 wherein the temperature gradient is at a minimum value and the specific heat value is at a maximum value for these two different modes of operation. By locating the temperature at which the maximum specific heat value occurs on dashed line 28, the pressure within gas cooler 14 can also be determined using the chart presented in FIG. 2.

Alternatively, the physical location of the maximum specific heat value within gas cooler 14 relative to the outlet of gas cooler 14 can be used in the determination of the pressure within gas cooler 14. As described above, the minimum temperature gradient within gas cooler 14 corresponds to the point at which the line BC intersects dashed line 28 wherein dashed line 28 is a locus of isotherm inflection points and maximum specific heat values. Once the physical location of this inflection point (INF) is known, the change in specific enthalpy, Δh, between the inflection point INF and the outlet of the gas cooler can be calculated using the following equation:

$$Q = \dot{m}\Delta h = \int_{INF}^{Outlet} \frac{\partial Q}{\partial L} dl \tag{1}$$

wherein Q is the amount of heat extracted from carbon dioxide gas between inflection point INF and the outlet of the gas cooler, m is the mass flow rate of the carbon dioxide through the gas cooler, $$\frac{\partial Q}{\partial L}$$

is the instantaneous heat transfer rate of the gas cooler, and dl is the differential length of the gas cooler. Assuming that $$\frac{\partial Q}{\partial L}$$

has constant value and that the carbon dioxide temperature at outlet 32 of gas cooler 14 equals the temperature of the ambient fluid surrounding gas cooler 14, the average heat transfer rate can be calculated using the following equation:

$$\left.\frac{\partial Q}{\partial L}\right|_{avg} \cong \alpha\pi d_o(T_{avgamb} - T_{avgtube}) \tag{2}$$

where α is the total heat transfer coefficient (including both convection and conduction), $d_o$ is the outer diameter of gas cooler tube 13, and $(T_{avgamb}-T_{avgtube})$ is the average temperature difference between the cooling medium temperature, e.g., ambient air temperature, and the outer tube wall temperature. The outer diameter of gas cooler tube 13, the average temperature of the cooling medium and the average temperature of the gas cooler tube 13 between the inflection point INF and gas cooler outlet 32 can be measured. The heat transfer coefficient can be determined empirically as discussed in greater detail below. The value of $$\left.\frac{\partial Q}{\partial L}\right|_{avg}$$

can be calculated using equation (2), however, this value is typically provided by the manufacturer of the heat exchanger and may also be determined empirically. Once the heat transfer rate is known, and assuming it to be a constant value, equation (1) can be rewritten to calculate the change in specific enthalpy using the following equation:

$$\Delta h_{INF} = \frac{1}{\dot{m}} \left.\frac{\partial Q}{\partial L}\right|_{avg} (\Delta L_{INF}) \tag{3}$$

wherein $\Delta L_{INF}$ is the length of gas cooler 14 between the inflection point INF and the outlet of the gas cooler. As can be seen in the schematic illustration of FIG. 4, the inflection point INF is assumed to be at the midpoint of the two points 34 which define the minimum temperature gradient along gas cooler 14 between the inlet 30 and outlet 32 of gas cooler 14. The length $\Delta L_{INF}$ extends from this inflection point INF to the outlet 32 of gas cooler 14. Alternatively, the location of the inflection point INF may be determined by fitting measured data from gas cooler 14 on a curve similar to that shown in FIG. 5 and locating the minimum temperature gradient, and thus the inflection point INF, on the curve.

Figure 6:
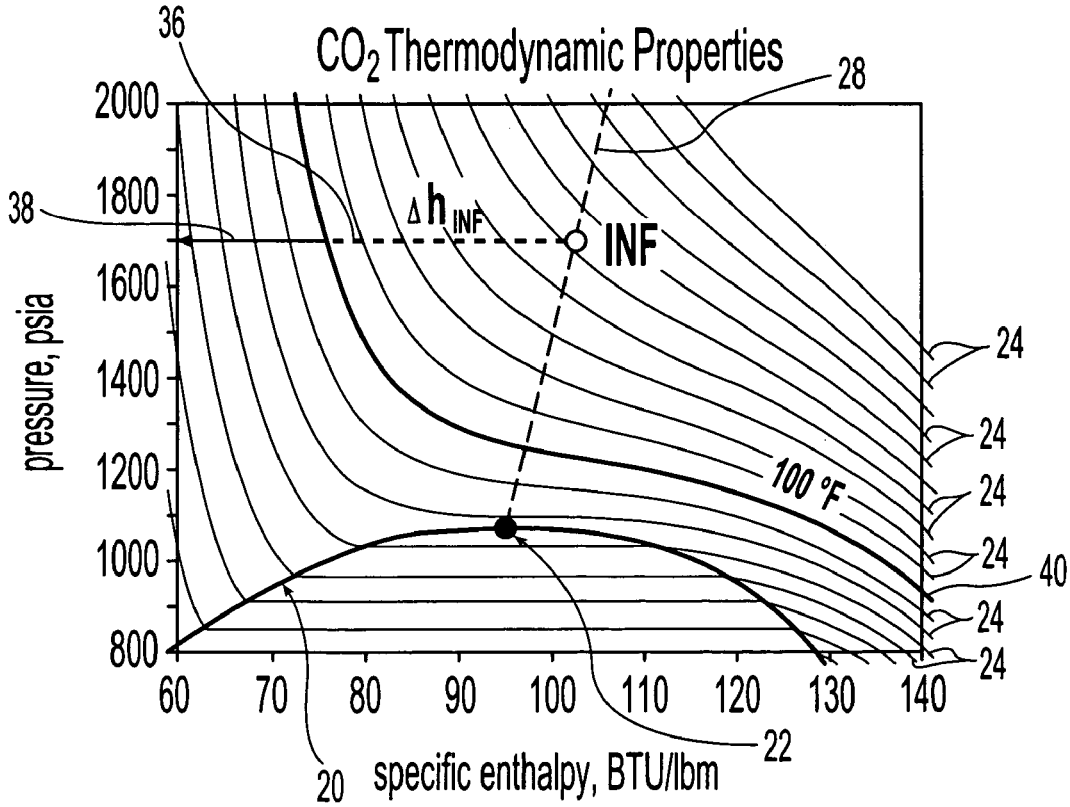
FIG. 6 is a pressure-enthalpy diagram for carbon dioxide that illustrates a method of determining the pressure of a supercritical refrigerant.

With the change in specific enthalpy having been calculated, the gas cooler pressure may be determined using the pressure-enthalpy diagram for carbon dioxide as shown in FIG. 6. With both the outlet temperature of gas cooler 14, i.e., isotherm line 40 in FIG. 6, and the magnitude of the change in specific enthalpy between the inflection point and the outlet, i.e., $\Delta h_{INF}$ represented by line segment 36 in FIG. 6, being known, the corresponding pressure can be determined by finding the pressure at which the distance between isotherm line 40 and dashed line 28 is equivalent to the length of line segment 36. In those embodiments which cool the refrigerant with ambient air, the outlet temperature of the gas cooler may be assumed to be equivalent to the ambient temperature. With the $\Delta h_{INF}$ line plotted on the pressure-enthalpy diagram, the pressure in the gas cooler can be read from the pressure axis of the chart as indicated by arrow 38 of FIG. 6.

Alternative methods for determining the pressure from the change in specific enthalpy and outlet temperature may also be employed. For example, a lookup table containing specific enthalpy values for various isotherms and inflection points together with the corresponding pressures, or, the use of appropriate mathematical equations describing the location of the isotherms and inflection points and corresponding pressures could be used instead of the graphical method discussed above.

A specific example in which the gas cooler pressure is determined in accordance with one embodiment of the present invention will now be discussed. In this example, the ambient temperature is 100° F. and the gas cooler has a heat exchange tube 13 with an outer diameter ($d_o$) of 0.250 inches and a heat transfer rate of heat exchanger $$\left(\frac{\partial Q}{\partial L}\right)$$

that is assumed to have a constant value of approximately 2113 Btu/ft. The mass flow rate is 300 lbm/hr and the measured length of $L_{INF}$ is 4.76 ft. Substituting these values into equation (3) one obtains:

$$\Delta h_{INF}=(1/300)*2113*4.76=27.4\ BTU/lbm$$

This value corresponds to a specific enthalpy variation per unit of length of:

$$(27.4\ BTU/\text{lbm})/4.76\ \text{ft}=5.76\ BTU/\text{ft.lbm}$$

Referring to FIG. 6, $\Delta h_{INF}$ line segment 36 has an end corresponding to outlet 32 that intersects isotherm 40 representing the ambient temperature 100° F. and an end corresponding to inflection point INF that intersects dashed line 28. The horizontally oriented $\Delta h_{INF}$ line segment 36 is moved vertically along isotherm 40 until the distance isotherm line 40 and dashed line 28 is equivalent to 27.4 BTU/lbm as read on the x-axis of the diagram. In this example, the specific enthalpy at inflection point INF is approximately 103 BTU/lbm and the specific enthalpy at outlet end 32 is approximately 76 BTU/lbm with the change in specific enthalpy being approximately 27. With $\Delta h_{INF}$ line segment 36 positioned properly on the pressure-enthalpy diagram, the pressure is approximated at 1700 psia as indicated by arrow 38.

Instead of employing the graphical method described above, the pressure may also be found using a look-up table. The use of a lookup table will facilitate the implementation of the present invention using a microprocessor or logic module. The following table presents a list of pressure values and corresponding specific enthalpy values at 100° F. (corresponding to the specific enthalpy at outlet 32 for an ambient temperature of 100° F.), the specific enthalpy value at the inflection point INF, and the difference between the two specific enthalpy values. Once the difference in the specific enthalpy has been determined to be approximately 27.4 BTU/lbm, this value can be looked up in the Δh column and the pressure is found to be 1700 psia. Similar tables can be prepared for different outlet temperatures.

Pressure and Specific enthalpy Values for Carbon Dioxide

| p, psia | h @ 100° F. (BTU/lbm) | h @ INF (BTU/lbm) | Δh (BTU/lbm) |
|---|---|---|---|
| 1080 | 128.9 | 95.0 | −33.8 |
| 1100 | 126.8 | 95.3 | −31.5 |

-continued

Pressure and Specific enthalpy Values for Carbon Dioxide

| p, psia | h @ 100° F. (BTU/lbm) | h @ INF (BTU/lbm) | Δh (BTU/lbm) |
|---|---|---|---|
| 1200 | 110.0 | 96.6 | −13.4 |
| 1300 | 89.0 | 98.1 | 9.0 |
| 1400 | 82.5 | 99.4 | 16.9 |
| 1500 | 79.4 | 100.8 | 21.4 |
| 1600 | 77.3 | 102.0 | 24.7 |
| 1700 | 75.7 | 103.2 | 27.4 |
| 1800 | 74.5 | 104.2 | 29.7 |
| 1900 | 73.5 | 105.1 | 31.6 |
| 2000 | 72.6 | 106.0 | 33.3 |
| 2100 | 71.9 | 106.7 | 34.9 |
| 2200 | 71.2 | 107.4 | 36.2 |
| 2300 | 70.6 | 108.0 | 37.4 |
| 2400 | 70.1 | 108.6 | 38.5 |
| 2500 | 69.6 | 109.1 | 39.4 |

Figure 11:
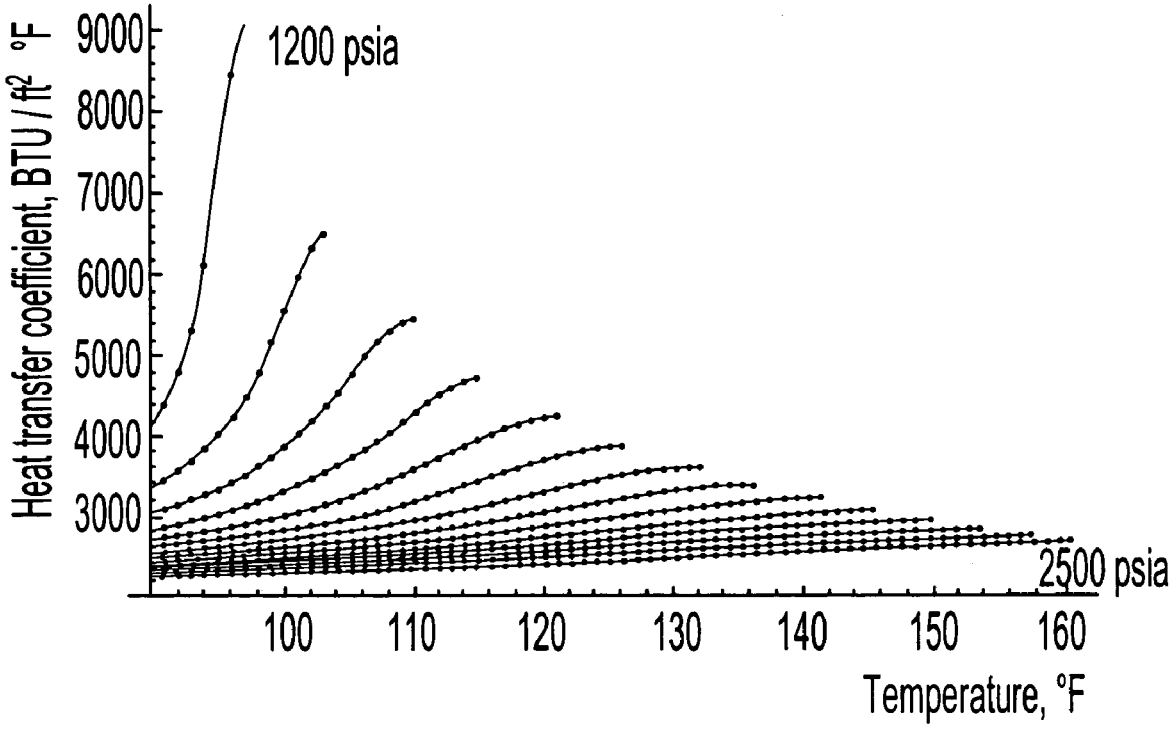
FIG. 11 is a chart of heat transfer coefficient values at different temperatures and pressures.

In another embodiment of the present invention, a more precise calculation of the gas cooler pressure can be made by taking into consideration the variation of heat transfer coefficient (α) with temperature and pressure and computing the heat transfer of the gas cooler using equation (2) set forth above. The pressure may then be determined as described above. This alternative method of computing the heat transfer rate may be particularly useful for providing more accurate results when the operating conditions within the gas cooler are nearing the critical point. FIG. 11 provides an example of a chart of heat transfer coefficients for different temperatures and pressures. As can be seen in FIG. 11, the heat transfer coefficient has greater variation when it is at a lower pressure. A 100 psia increment is used between the individual pressure curves depicted in FIG. 11. An iterative computational process may be required with this embodiment of the invention.

Alternative embodiments of the present invention may account for additional criteria including non uniformity of air flow velocity and temperature and carbon dioxide gas pressure drop along the gas cooler tube. For example, such an embodiment may utilize an experimental method that includes varying the operation of system 10 to compile a table of pressures, ambient temperatures, changes in specific enthalpy, and gas cooler lengths that may be used to determine the gas cooler pressure. This type of method could also take into account various other operating parameters such as the intermediate cooling temperature (for a system employing a two stage compressor), suction line heat exchanger efficiency, flash gas removal usage, gas cooler thermal conductivity, and approach temperature. This type of method may be advantageously employed on an existing carbon dioxide system when upgrading the system to include capacity and/or efficiency controls.

Figure 7:
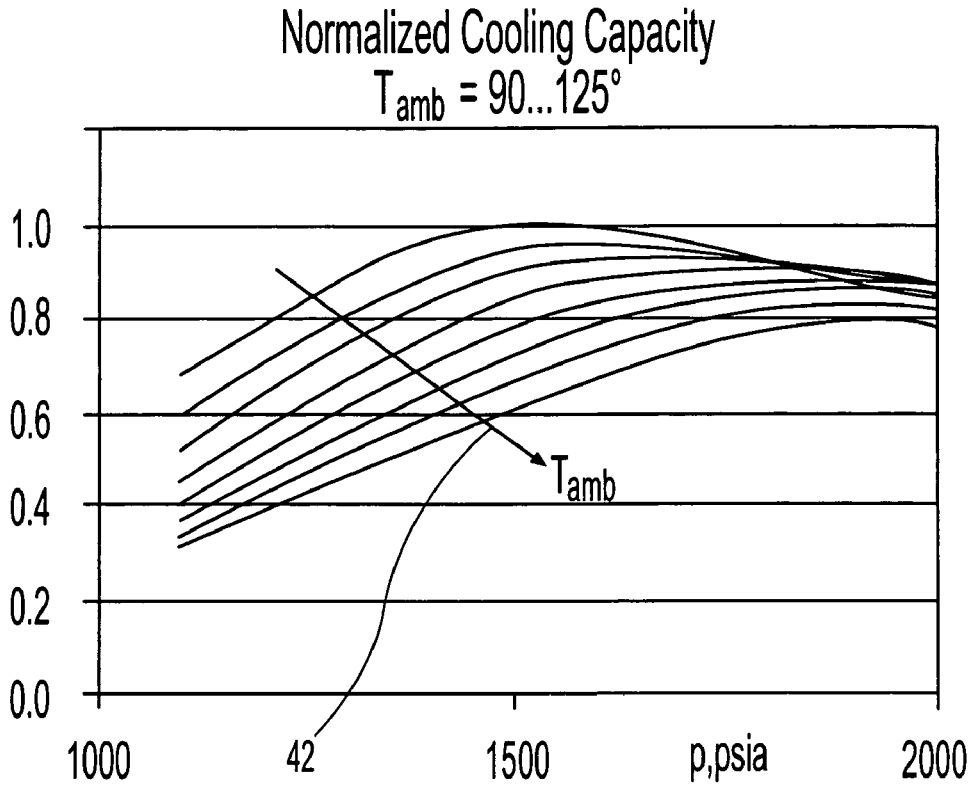
FIG. 7 is a normalized cooling capacity-pressure diagram for carbon dioxide at several different temperatures.
Figure 8:
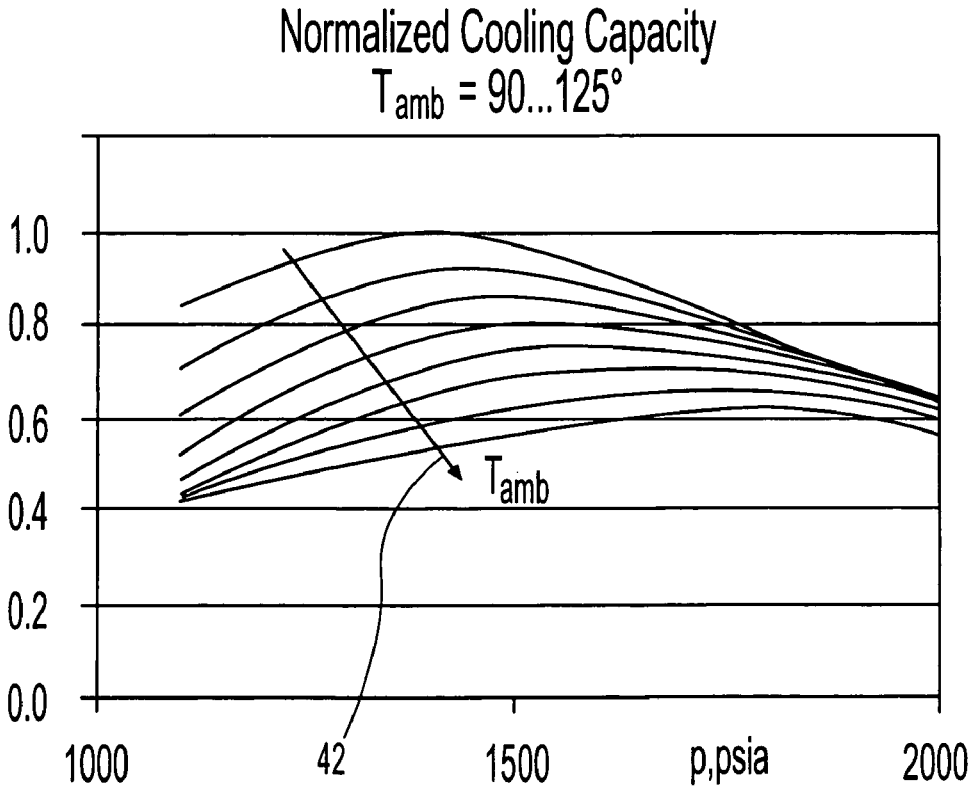
FIG. 8 is a normalized COP-pressure diagram for carbon dioxide at several different temperatures.

Once the pressure of the supercritical refrigerant within gas cooler 14 is known, the capacity and coefficient of performance (COP) of the system can be monitored and the operation of the system may also be controlled to effect changes in the capacity or COP. FIGS. 7 and 8 are charts that represent the normalized cooling capacity and COP of system 10.

With regard to FIG. 7, the vertical axis represents the normalized cooling capacity of the system wherein 1.0 is the maximum cooling capacity of the system when the ambient temperature is 90° F. The horizontal axis represents the pressure within gas cooler 14. Individual curves for ambient temperatures ranging from 90° F. to 125° F. in 5° F.

increments are illustrated with arrow 42 indicating the direction of increasing ambient temperatures.

Similarly, in FIG. 8, the vertical axis represents the normalized COP of the system wherein 1.0 is the maximum COP of the system when the ambient temperature is 90° F. The horizontal axis represents the pressure within gas cooler 14. Individual curves for ambient temperatures ranging from 90° F. to 125° F. in 5° F. increments are illustrated with arrow 42 indicating the direction of increasing ambient temperatures.

Figure 9:
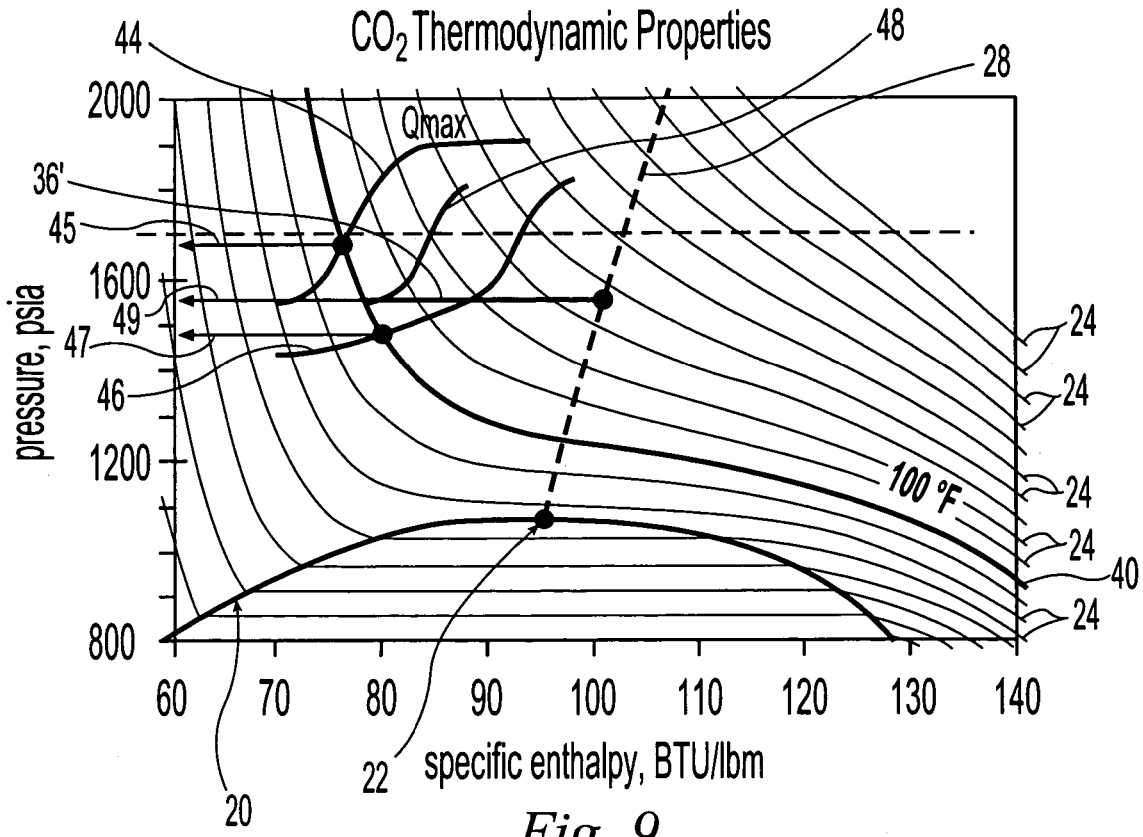
FIG. 9 is pressure-enthalpy diagram for carbon dioxide that includes maximum capacity and COP curves and an optimum operating parameters curve.

At each ambient temperature, the cooling capacity and the COP each have a maximum value which occur at different pressures. Because the maximum values for capacity and COP occur at different pressures, it is not possible to maximize both the capacity and COP at the same time. The maximum capacity and COP values for specific ambient temperatures (which correspond to the gas cooler outlet temperature) illustrated in FIGS. 7 and 8 are represented in FIG. 9 by the $Q_{max}$ and $COP_{max}$ curves 44, 46 respectively. Referring to FIG. 9, the $Q_{max}$ and $COP_{max}$ curves plot the pressures for the maximum capacity and COP respectively on isotherm lines 24. Depending upon the operating conditions and applications of the system, it may be desired to optimize either the cooling capacity or the COP. Alternatively, operation of the system at a capacity and efficiency between the optimized conditions, as illustrated by line 48, may be desirable.

The operation of system 10 may be controlled in a variety of ways to alter the pressure in gas cooler 14 and thereby regulate the capacity and COP of system 10. For example, compressor 12 may be a variable compressor that can be controlled to adjust the discharge pressure or expansion device 16 may be a variable expansion valve whereby adjustment of valve 16 can be used to control the operation of the system. Other methods of controlling the operation of a transcritical vapor compression system may include the control of an air blower associated with heat exchanger 14 or 18, various valving arrangements, or by controlling the quantity of refrigerant charge actively circulating through the system. For example, one method of controlling a transcritical vapor compression system is described by Manole in U.S. patent application Ser. No. 10/653,581 filed on Sep. 2, 2003 and entitled "Multi-Stage Vapor Compression System with Intermediate Pressure Vessel" which is hereby incorporated herein by reference.

With regards to the illustrative example discussed above, the gas cooler pressure was determined to be 1700 psia and the ambient/gas cooler outlet temperature was 100° F. As shown in FIG. 9, with an outlet temperature of 100° F., the pressure associated with the maximum cooling capacity is approximately 1680 psia as indicated by arrow 45 and the pressure associated with the maximum COP is approximately 1480 psia as indicated by arrow 47. Therefore, it would be desirable to reduce the pressure within gas cooler 14 in the illustrative example.

Referring again to FIG. 9, optimization curve 48 is positioned between the $Q_{max}$ curve 44 and the $COP_{max}$ curve 46. Curve 48 represents a compromise between maximizing the capacity and maximizing the efficiency of system 10. As graphically illustrated in FIG. 9, if system 10 is operated to conform to optimization curve 48, if the pressure within gas cooler 14 deviates from the desired pressure for a given temperature, it will initially move closer to either the $Q_{max}$ curve 44 or $COP_{max}$ curve 46, thus, improving either the capacity or efficiency while degrading the other. It is only when the operating conditions pass through either curve 44 or 46 that both the capacity and efficiency of the system may become degraded. In the illustrative example, with an ambient temperature of 100° F., the optimized gas cooler pressure is approximately 1550 psia as indicated by arrow 49.

When the current gas cooler pressure differs from the desired pressure, it is possible to determine the desired distance $L_{INF}$ between the inflection point INF and the gas cooler outlet 32 that corresponds to the desired pressure of 1550 psia. First, the current specific enthalpy variation per unit length of gas cooler 14 is found by dividing the calculated change in specific enthalpy, $\Delta h_{INF}$, by the current actual length $L_{INF}$ of the gas cooler between inflection point INF and the gas cooler outlet. In the example set forth above, the specific enthalpy variation per unit length is found by dividing 27.4 Btu/lbm by 4.76 ft to thereby obtain 5.76 Btu/(lbm ft ° F.). The $\Delta h_{INF}$ line segment 36', shown in FIG. 9, extends between dashed line 28 and the optimization curve 48 at the location where optimization curve intersects the current ambient temperature isotherm. In the illustrative example the ambient temperature is 100° F. and the corresponding desired gas cooler pressure is 1550 psia. The length of line segment 36' corresponds to the desired $\Delta h_{INF}$, i.e., the change in specific enthalpy between the inflection point INF and the gas cooler outlet 32 at the desired operating parameters of gas cooler 14 for the ambient temperature. In this example, line segment 36' corresponds to a $\Delta h_{INF}$ value of approximately 22 Btu/lbm. This value is divided by the specific enthalpy variation, 5.76 Btu/(lbm ft ° F.), to calculate the desired length of $L_{INF}$, i.e., the distance between the inflection point INF and outlet 32 of gas cooler 14, which, in this example, is approximately 3.88 ft.

Operation of system 10 may then be adjusted, e.g., by control of compressor 12 or expansion device 16, until the minimal temperature gradient measured on gas cooler 14 occurs 3.88 ft from gas cooler outlet 14. Alternatively, system 10 could be regulated to maximize either the capacity or COP of the system by employing a similar method and using either the $Q_{max}$ curve 44 or the $COP_{max}$ curve 46 instead of optimization curve 48 to determine the desired length of $L_{INF}$.

Providing a system 10 wherein the pressure of gas cooler 14 may be varied to optimize either the capacity or efficiency of the system under changing load conditions, i.e., a system wherein the desired length of $L_{INF}$ is varied to address changing operating conditions, will typically be more expensive than a system which is operated to maintain $L_{INF}$ at a constant length. For many applications, however, e.g., water heaters and air conditioners in relatively stable environments, the operating conditions of the system may not be subject to large variations in operating loads and conditions. For such applications it may be suitable to provide a system 10 wherein the system is operated to maintain the length of $L_{INF}$ at a constant length. As can be seen in FIG. 9, the horizontal distance between optimization line 48 and dashed line 28 remains fairly constant throughout its middle length and by choosing an appropriate length of $L_{INF}$ the system may be operated at conditions which balance the capacity and efficiency of the system, e.g., such as that exemplified by optimization line 48, over a range of operating conditions.

Figure 10:
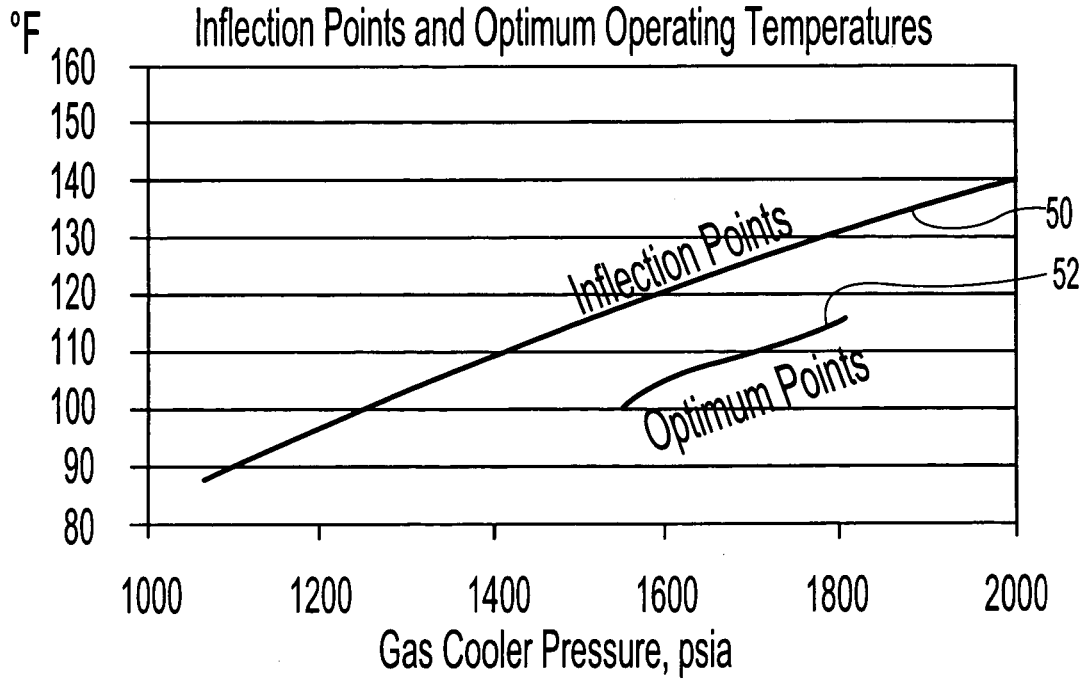
FIG. 10 is a temperature-pressure diagram for the gas cooler of FIG. 1 which includes an inflection point curve and optimum operating parameters curve.

FIG. 10 plots the pressure and temperature of an inflection point curve 50 and a optimum points curve 52 wherein the inflection point curve 50 corresponds to dashed line 28 and optimum points curve 52 corresponds to optimization curve 48. As seen in FIG. 10, the vertical distance between curves 50 and 52 is relatively constant indicating that the temperature difference between the inflection point INF and gas cooler outlet 32 is relatively constant over the plotted range of gas cooler pressures, i.e., approximately 1500 to 1900 psia in the illustrated example. In the illustrated example, the average temperature difference between curves 50 and 52 for this pressure range is approximately 13.7° F. Consequently, system 10 may alternatively be regulated over a range of operating conditions by maintaining a desired temperature difference between the gas cooler outlet 32 and the inflection point INF, e.g., a temperature difference of 13.7° F. in the illustrated example.

In the schematic illustration of FIG. 4, numerous equally spaced sensing locations 34 are illustrated along the full length of heat exchanger tube 13. By providing a large number of sensing locations 34, the location and/or temperature of the inflection point INF can be determined with greater precision. The location of inflection point INF, however, can be estimated with as few as three sensing locations 34, or, if the ambient temperature is known and the temperature of the refrigerant at outlet 32 is assumed to be equivalent to the ambient temperature, with only two sensing locations 34. With three known temperatures, or other suitable measurement dependent upon the temperature of the refrigerant within tube 13, at known locations on tube 13, a second order polynomial curve can be fit to the three known data points. The curve estimated thereby may then be used to determine the location and/or temperature of the inflection point INF on gas cooler 14 which may then be used as described above to monitor or regulate system 10.

Measurements may be taken along tube 13 of gas cooler 14 at locations 34 using a variety of different sensing devices. For example, the temperature of tube 13 may be measured directly using a temperature sensor or thermistor. Alternatively, strain gages may be used to measure the thermal expansion of tube 13. When using strain gage measurements, it is possible to convert the measurements to temperature readings, or, the strain gage measurements may be directly compared to identify the relative temperature differences between points 34 without converting such measurements into temperature readings. For example, in some embodiments of the present invention, strain gage measurements may be used to identify the location of the minimal temperature gradient within heat exchanger 14, which would correspond to a minimal change in strain per unit length, without determining a corresponding temperature reading.

The sensing devices generate signals representative of the sensed parameter. The signals may then be processed by a comparator or other suitable means. For example, an analog to digital converter may be employed to convert the sensing device signals to a digital format before the signals are processed by a suitable device such as a logic module or microprocessor. The signals are then processed as described above to determine the gas cooler pressure, optimal location or temperature of the inflection point on the gas cooler, or other desired parameter. This information may then be employed in the control and regulation of system 10, e.g., by a controller to adjust the operating parameters of compressor 12 or expansion device 16.

In the illustrated embodiment, gas cooler 14 is a conventional tube and fin heat exchanger that exchanges thermal energy with the ambient air. The present invention, however, may also be employed with other types of heat exchangers. For example, with appropriate modifications, the methods described above could be employed with a microchannel heat exchanger or a tube-within-a-tube heat exchanger that exchanges thermal energy between the refrigerant and a second heat exchange medium, such as water, conveyed within one of the tubes.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A method of determining the supercritical pressure of a refrigerant in a heat exchanger in a transcritical vapor compression system, said method comprising:

obtaining a plurality of measurements representative of the temperature of the refrigerant at spaced locations on the heat exchanger;

identifying a first location based upon said plurality of measurements wherein said first location is the approximate location of the minimum temperature gradient of the refrigerant within the heat exchanger; and determining the pressure of the refrigerant within the heat exchanger based upon the identification of said first location.

2. The method of claim 1 wherein determining the pressure of the refrigerant comprises determining the approximate temperature of the refrigerant at said first location and determining the pressure at which the refrigerant has a maximum specific heat at a temperature equivalent to the temperature of the refrigerant at the first location.

3. The method of claim 2 wherein determination of the pressure comprises the use of a look-up table.

4. The method of claim 1 wherein determination of the pressure comprises determining a value that is a function of the approximate change in specific enthalpy of the refrigerant between said first location and an outlet of said heat exchanger.

5. The method of claim 4 wherein determination of the pressure further comprises determining the approximate temperature of the refrigerant at said outlet.

6. The method of claim 1 wherein determining the pressure of the refrigerant comprises:

determining the approximate temperature of the refrigerant at a second location spaced from said first location;

determining a value that is a function of the approximate change in specific enthalpy of the refrigerant between said first location and said second location;

determining the pressure of the refrigerant at said first location based upon said approximate temperature of the refrigerant at said second location and said value that is a function of the approximate change in specific enthalpy between said first and second locations.

7. The method of claim 6 wherein the heat exchanger is cooled using ambient air and said second location is the heat exchanger outlet; and wherein the temperature of the refrigerant at said second location is estimated to be equivalent to the temperature of the ambient air.

8. The method of claim 6 wherein the value that is a function of the approximate change in specific enthalpy is the approximate change in specific enthalpy between said first and second locations and determining the value includes using the following equation:

$$\Delta h_{INF} = \frac{1}{\dot{m}} \frac{\partial Q}{\partial L}\bigg|_{avg} (\Delta L_{INF})$$

wherein:

$\Delta h_{INF}$ is the change in specific enthalpy;

$\dot{m}$ is the mass flow rate of refrigerant through the heat exchanger;

$$\left.\frac{\partial Q}{\partial L}\right|_{avg}$$

is the average heat transfer rate of the heat exchanger; $\Delta L_{INF}$ is the length between the first and second locations.

9. The method of claim 1 wherein the step of obtaining a plurality of measurements representative of the temperature of the refrigerant at spaced locations on the heat exchanger comprises obtaining temperature measurements on the exterior surface of the heat exchanger.

10. The method of claim 1 wherein the step of obtaining a plurality of measurements representative of the temperature of the refrigerant at spaced locations on the heat exchanger comprises obtaining strain measurements of the heat exchanger structure.

11. The method of claim 1 wherein the step of identifying said first location comprises comparing adjacent measurements of said plurality of measurements and selecting a pair of adjacent measurements that define the minimal difference between said adjacent measurements.

12. The method of claim 1 wherein the step of identifying said first location comprises defining a curve based upon said plurality of measurements and the position of said measurements on said heat exchanger.

13. A method of controlling the operation of a transcritical vapor compression system wherein the vapor compression system defines a closed loop circuit through which a refrigerant is circulated and including therein, in serial order, a compressor, a first heat exchanger, an expansion device and a second heat exchanger wherein the refrigerant is at a supercritical pressure within the first heat exchanger; said method comprising:

identifying a first location on the first heat exchanger wherein said first location is the approximate location of the minimum temperature gradient of the refrigerant within the heat exchanger;

regulating the operation of the transcritical vapor compression system by controlling at least one characteristic of said first location.

14. The method of claim 13 wherein a first distance separates said first location from an outlet of said first heat exchanger and said at least one characteristic of said first location includes said first distance.

15. The method of claim 14 wherein said step of regulating the operation of the transcritical vapor compression system comprises maintaining said first distance between said first location and said outlet of said first heat exchanger at a relatively constant value.

16. The method of claim 13 wherein said at least one characteristic of said first location includes the temperature of refrigerant at said first location.

17. The method of claim 16 wherein said step of regulating the operation of the transcritical vapor compression system comprises maintaining a desired temperature difference between refrigerant at said first location and refrigerant at an outlet of said first heat exchanger.

18. The method of claim 17 wherein said first heat exchanger utilizes ambient air as a cooling medium and the temperature of refrigerant at said outlet of said first heat exchanger is assumed to be equivalent to the temperature of the ambient air.

19. The method of claim 17 wherein said desired temperature difference is non-variable.

20. A transcritical vapor compression system, said system comprising:

a closed loop circuit through which a refrigerant is circulated, said circuit including, in serial order, a compressor, a first heat exchanger, an expansion device and a second heat exchanger and wherein the refrigerant is at a supercritical pressure within said first heat exchanger;

a plurality of sensing devices mounted on said first heat exchanger at spaced locations each of said devices generating a signal representative of the temperature of the refrigerant within said first heat exchanger at a respective one of said spaced locations;

means for identifying a first location based upon said signals wherein said first location is the approximate location of the minimum temperature gradient of the refrigerant within said first heat exchanger; and means for determining the pressure of the refrigerant within said first heat exchanger based upon the identification of said first location.

21. The transcritical vapor compression system of claim 20 wherein said means for determining the pressure of the refrigerant comprises measuring the temperature of the refrigerant at said first location and determining the pressure at which the refrigerant has a maximum specific heat at a temperature equivalent to the temperature of the refrigerant at said first location.

22. The transcritical vapor compression system of claim 20 wherein said means for determining the pressure of the refrigerant comprises determining the approximate temperature of the refrigerant at a second location spaced from said first location; determining the approximate change in specific enthalpy of the refrigerant between said first location and said second location; and determining the pressure of the refrigerant at said first location based upon said approximate temperature of the refrigerant at said second location and said approximate change in specific enthalpy between said first and second locations.

23. The transcritical vapor compression system of claim 20 wherein said plurality of sensing devices sense the temperature of said first heat exchanger at said spaced locations.

24. The transcritical vapor compression system of claim 20 wherein said plurality of sensing devices sense the strain of said first heat exchanger at said spaced locations.

25. The transcritical vapor compression system of claim 20 wherein said means for identifying said first location comprises comparing signals of adjacent ones of said plurality of measuring devices and selecting a pair of adjacent devices that define the minimal difference between said signals of said adjacent devices.

26. The transcritical vapor compression system of claim 20 wherein said means for identifying said first location comprises defining a curve based upon said plurality of signals and the respective positions of said sensing devices generating said signals.

* * * * *